US007276654B1

(12) United States Patent
Parisi

(10) Patent No.: US 7,276,654 B1
(45) Date of Patent: Oct. 2, 2007

(54) MULTIPLE CYMBALS ACTUATOR APPARATUS

(76) Inventor: Joseph A. Parisi, 1745 McCormick, Turlock, CA (US) 95380

( * ) Notice: Subject to any disclaimer, the term of this patent is extended or adjusted under 35 U.S.C. 154(b) by 0 days.

(21) Appl. No.: 11/045,823

(22) Filed: Jan. 27, 2005

(51) Int. Cl.
*G10D 13/02* (2006.01)

(52) U.S. Cl. ..... 84/422.3; 84/421

(58) Field of Classification Search ..... 84/422.3, 84/422.1, 327, 329, 421
See application file for complete search history.

(56) References Cited

U.S. PATENT DOCUMENTS 2,581,515 A * 1/1952 Christian ..... 84/422.1
4,111,095 A * 9/1978 Simons ..... 84/422.3
5,739,447 A * 4/1998 Hoshino ..... 84/402
6,331,667 B1 12/2001 Kuppers

* cited by examiner

*Primary Examiner*—Lincoln Donovan
*Assistant Examiner*—Jianchun Qin
(74) *Attorney, Agent, or Firm*—Willaim W Haefliger

(57) ABSTRACT

A cymbals stand comprising upper and lower cymbals pairs on the stand, each pair having primary and secondary discs adapted to be moved relatively toward one another to clash; an actuator rod projecting upwardly, and movable upwardly and downwardly; and structure including a pin or pins for attaching at least one of the cymbals of at least one pair to the rod, to be moved by the rod relative to the other pair of cymbals.

7 Claims, 5 Drawing Sheets

14
55
54
50
51
10
10a
52
56
10b
52'
4
4
53
59
27

MULTIPLE CYMBALS ACTUATOR APPARATUS

BACKGROUND OF THE INVENTION

This invention relates generally to improved actuation of cymbals, and more particularly to dual cymbals to be operated in unison, or substantially in unison.

When two sets of cymbals are to be operated at the same time, there is need for means or method to achieve this result in a simple, effective way. When a single set of cymbals is operated, a rod is typically displaced endwise so as to clash the cymbals; however, the use of a single rod to operate two sets of cymbals, in the simple, effective manner as disclosed herein, was not previously known or made possible. One complex way of causing upper and lower cymbals to clash against a middle cymbals is disclosed in U.S. Pat. No. 6,331,667 to Kuppers.

SUMMARY OF THE INVENTION

It is a major object of the invention to provide apparatus meeting the above need. Basically, apparatus incorporating the invention comprises:

a) upper and lower cymbals pairs on the stand, each pair having primary and secondary discs adapted to be moved relatively toward one another to clash, b) an actuator rod projecting upwardly, and movable upwardly and downwardly, c) and first means for attaching at least one of the cymbals of at least one pair to said rod, to be moved by the rod relative to the other cymbals of said pair.

Another object includes the provision of a pin or pins to attach to the rod, the pin or pins projecting to connect to a cymbals or cymbals support.

A further object includes provision of vertically spaced side openings in the rod, to which the pin or pins are selectively connectible.

Yet another object includes provision of an upright support that does not move up and down, at least one cymbals disc of each pair carried by said support, whereby the other cymbals disc of each pair is movable by the rod relative to said support. As will be seen, that support may comprise a sleeve within which the rod projects; and the sleeve may have a side slot through which the pin or pins project laterally.

These and other objects and advantages of the invention, as well as the details of an illustrative embodiment, will be more fully understood from the following specification and drawings, in which:

DRAWING DESCRIPTION

Figure 1:
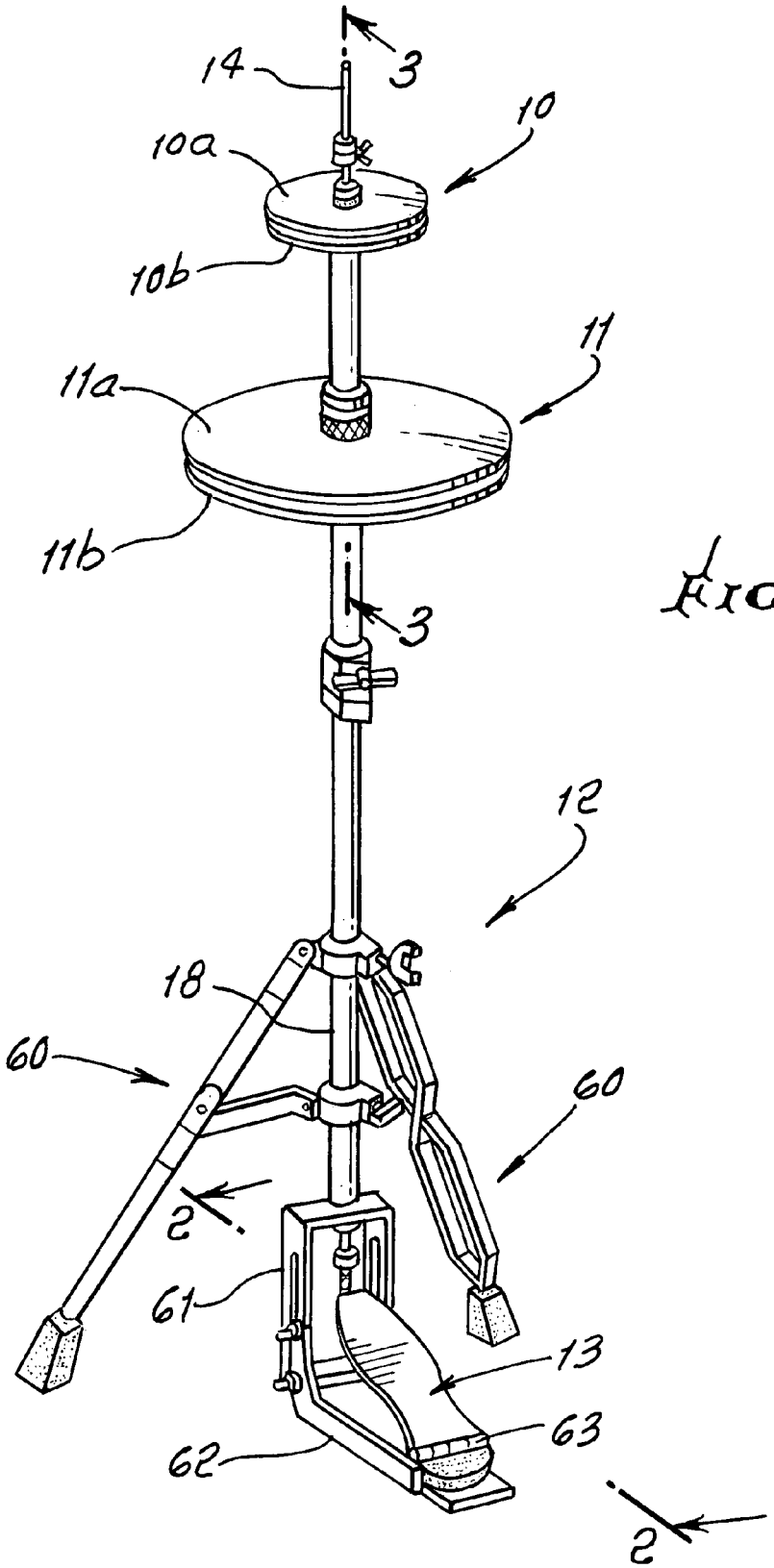
FIG. 1 is an elevation taken in perspective, to show a preferred cymbals apparatus incorporating the invention.
Figure 3A:
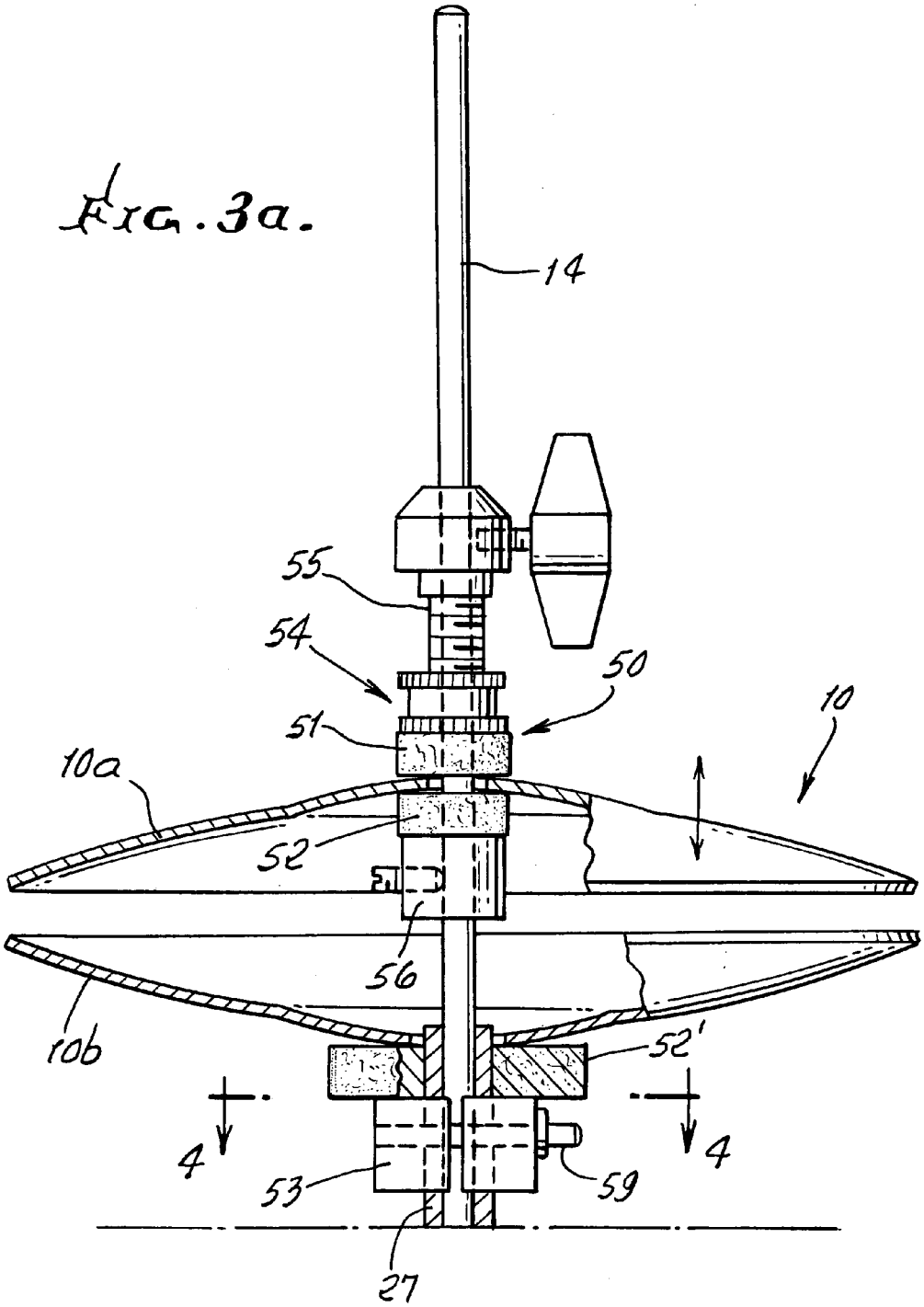
Figure 3B:
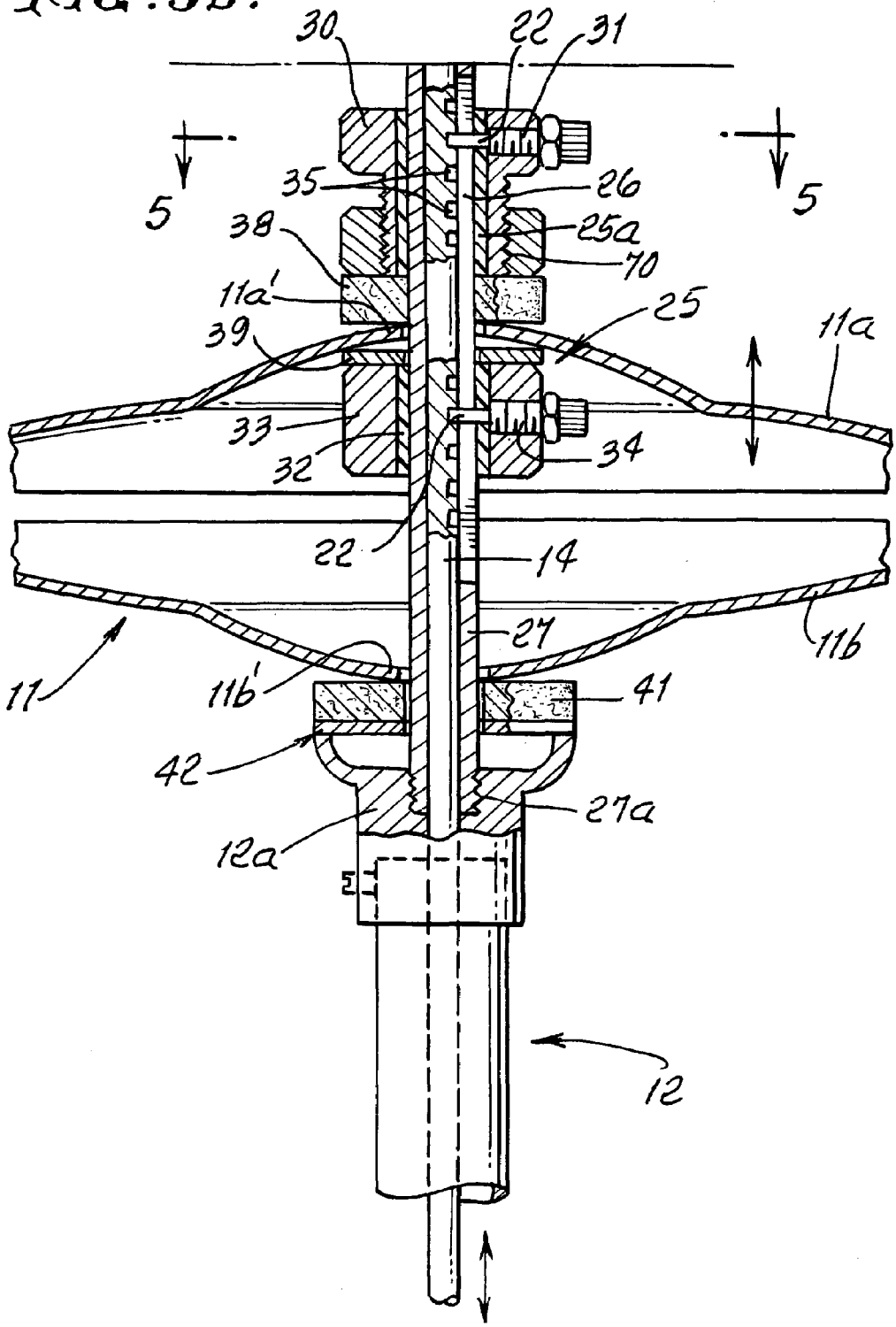
Figure 4:
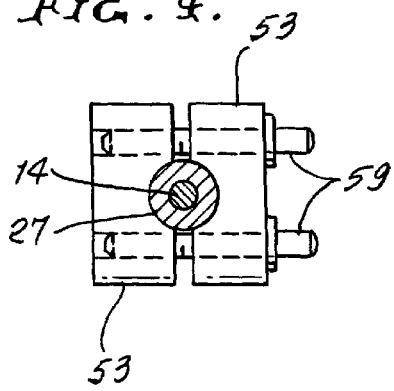

FIGS. 3*a* and 3*b* are enlarged side elevations, partly broken away, and taken on lines 3—3 of FIG. 1;

FIG. 4 is a plan view taken in section on lines 4—4 of FIG. 3*a;*

Figure 6:
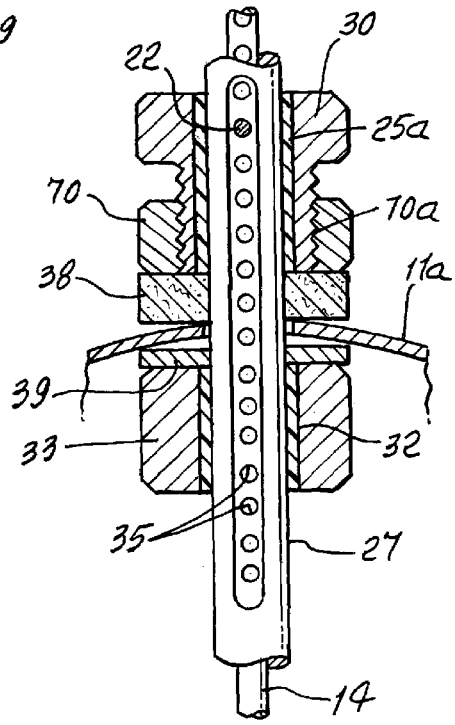
Figure 5:
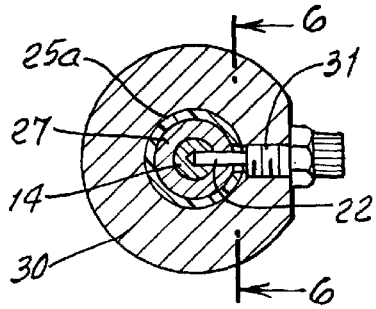

FIG. 5 is a plan view taken in section on lines 5—5 of FIG. 3*b*; and FIG. 6 is a section taken in elevation on lines 6—6 of FIG. 5.

DETAILED DESCRIPTION

Referring to FIG. 1, it shows upper and lower cymbals pairs 10 and 11 carried by an upright stand 12. Cymbals pair 10 includes upper and lower cymbals discs 10*a* and 10*b*; and pair 11 includes upper and lower cymbals discs 11*a* and 11*b*. Thus, each pair has primary and secondary metallic discs adapted to be moved relatively toward one another to clash. In the example, the upper disc of each pair is movable downwardly toward the lower disc of each pair, when a foot operated pedal 13 is pushed downwardly, whereby the upper discs clash at generally the same time that the lower discs clash.

Figure 2:
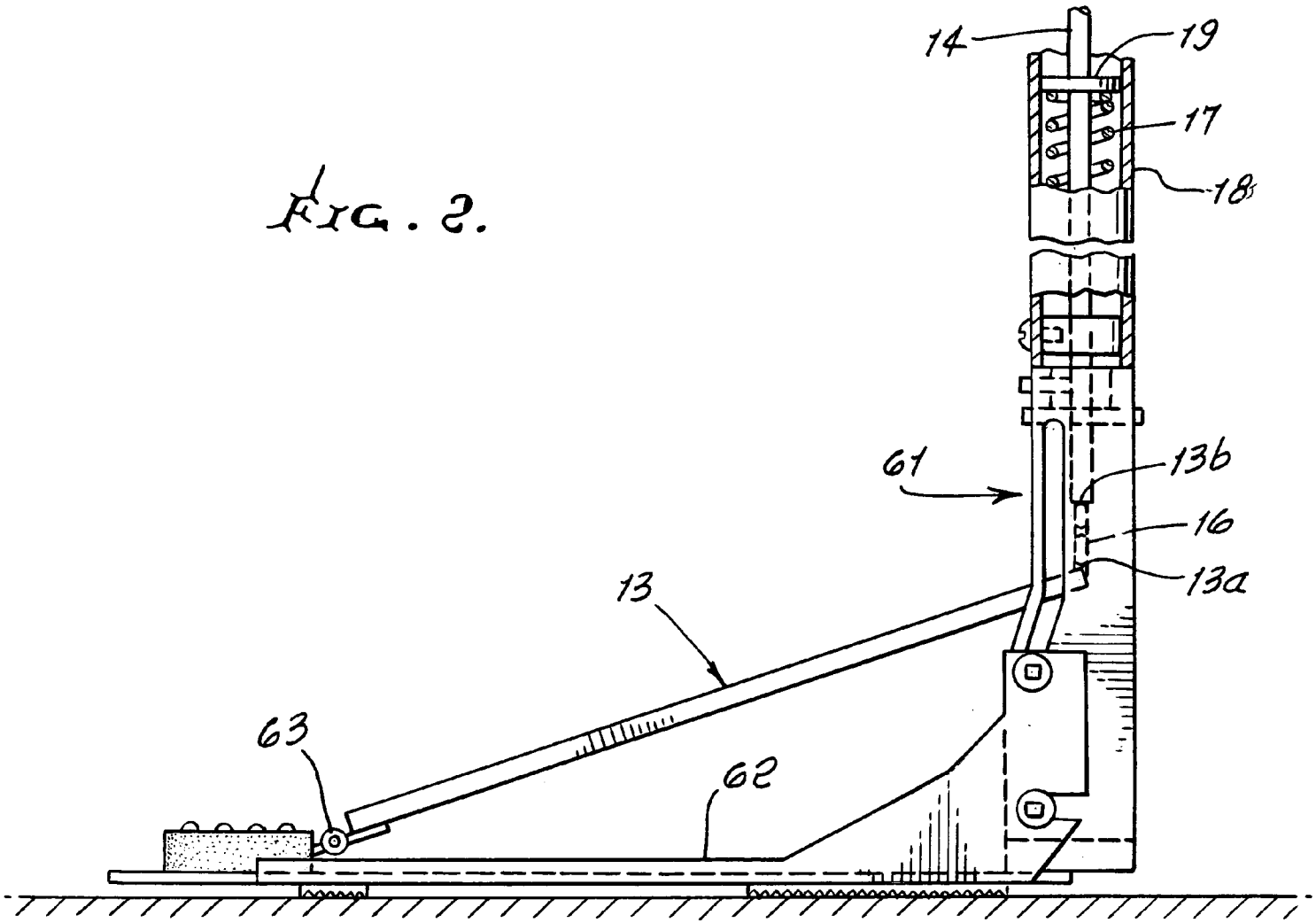
FIG. 2 is an enlarged side elevation taken on lines 2—2 of FIG. 1.

This motion is effected by downward travel of an actuator rod 14 projecting upwardly internally of the stand, and movable endwise upwardly and downwardly. Note that rod 14 is operatively connected to pedal 13 via chain 16 connected at 13*a* to the forward end of pedal 13, the chain connected to the rod at 13*b*. A compression spring 17 within stand outer sleeve 18 yieldably resists downward movement of the rod, as by engagement with a flange 19 connected to the rod. See FIG. 2.

Means is provided for attaching at least one of the cymbals of at least one pair to said rod, to be moved by the rod relative to the other cymbals of said pair. Such means may include a pin or pins 22 that extend or extends laterally to connect rod 14 to structure 25 associated with upper cymbals 11*a* of lower pair 11, whereby when the rod moves downwardly, cymbals disc 11*a* is carried downwardly to clash with disc 11*b*. Note that pins 22 project laterally through a vertically elongated slot or slots 26 through the side wall of an internal sleeve 27 in and integral with the stand. See thread 27*a* connecting the lower end of sleeve 27 to the stand tubing 12*a*.

Structure 25 is generally movable up and down on the sleeve 27 and orients the cymbals disc 11*a* for peripheral clashing with stationary disc 11*b*. Structure 25 is shown to include an upper tubular bearing 25*a* slidable on and along the sleeve 27 and received in a support sleeve 30 to which upper pin 22 is adjustably connected at 31; and a lower tubular bearing 32 slidable on and along the sleeve 27 and received in a support sleeve or collar 33 to which lower pin 22 is adjustably connected at 34. Adjusters at 31 and 34 allow retraction of the pins from selected openings 35 in the rod, and their insertion into other of the openings, to vertically adjust the position of the upper disc 11*a* relative to the lower disc 11*b*. Note loose retention of the central portion 11*a*' of disc 11*a* between annular cushion 38 and washer 39 allowing automatic tilt self-adjustment of that disc relative to the lower disc, as during clashing. Adjusting nut 70 is threaded at 70*a* on 30, to controllably press on 38.

Lower disc 11*b* has a central portion 11*b*' that rests on an annular cushion 41, allowing automatic tilt self adjustment of that disc, as during clashing. Cushion 41 is retained on the stand, at 42.

As shown in FIG. 3*a*, the upper end of the rod 14 moves the upper cymbals disc 10*a* up and down, as during play of the cymbals, whereby the upper discs of said cymbals move simultaneously. See for example structure 50 connecting rod 14 to disc 10*a*, and including cushions 51 and 52 above and below the central portion of the disc, retainer 53 supporting lower cushion 52' and attached to the rod via set screw 59. Upper cushion holder 54 is rotatable on screw thread 55 to adjust upper cushion 51, and adjustable clamp 56 adjustably supports and positions the holder 54 and clamp to the rod. Rod 14 projects up through the upper end of sleeve 27.

The stand 12 has two adjustable legs 60, and a central lower support frame 61 projecting upwardly from a base 62 on which the pedal is hinged at 63 for up and down pivoted movement.

I claim:

1. In a cymbals stand, the combination comprising a) upper and lower cymbals pairs on the stand, each pair having primary and secondary discs adapted to be moved relatively toward one another to clash, b) an actuator rod projecting upwardly, and movable upwardly and downwardly, c) and first means for attaching at least one of the cymbals of at least one pair to said rod, to be moved by the rod relative to the other cymbals of said pair, said means including a pin or pins to removably attach to the rod, d) and including an upright support that does not move up and down, at least one cymbal of each pair carried by said support, whereby the other cymbal of each pair is movable by the rod relative to said support, e) pin adjusters, f) a compression spring resisting rod downward movement with the sleeve, g) and including an upright support comprising a sleeve that does not move up and down, at least one cymbal of each pair carried by said support, whereby the other cymbal of each pair is movable by the rod relative to said support, the rod having vertically spaced side openings above and below said other cymbals to selectively receive the pins, the support comprising a sleeve within which said rod projects, the sleeve having a vertically elongated side slot sidewardly and openly facing said side openings and through which the pins project laterally.

2. The combination of claim 1 wherein said means includes collars attached to sections of the cymbals, and carrying said pins.

3. The combination of claim 1 wherein the actuator rod extends upwardly through tilt supports of the cymbals.

4. The combination of claim 1 including structure guidedly movable up and down on the sleeve, and connected to said one cymbals of the pair.

5. The combination of claim 4 including upper and lower adjusters carried by said structure for selectively connecting upper and lower of said pins to the rod, the upper pin located above the cymbals disc and the lower pin located below the cymbals disc.

6. The combination of claim 1 including second means for attaching a cymbals disc of the other pair, directly to the rod.

7. The combination of claim 6 wherein said second means is above said first means.

* * * * *